United States Patent [19]

Johnson

[11] 4,172,610

[45] Oct. 30, 1979

[54] ICE CUBE PICKUP DEVICE

[76] Inventor: Verlene G. Johnson, 476 W. 165th St. #5C, New York, N.Y. 10032

[21] Appl. No.: 925,283

[22] Filed: Jul. 17, 1978

[51] Int. Cl.[2] ..... B25B 3/00

[52] U.S. Cl. ..... 294/100; 294/19 R

[58] Field of Search ..... 294/100, 115, 50.7, 294/50.8, 19 R, 19 A, 26, 110 A, 40 R, 41

[56] References Cited

U.S. PATENT DOCUMENTS

| | | | |
|---|---|---|---|
| 2,320,967 | 6/1943 | Dunkelberger | 294/100 |
| 2,752,625 | 7/1957 | Donsell | 294/100 |
| 3,833,252 | 9/1974 | Redding | 294/100 |

*Primary Examiner*—James B. Marbert

*Attorney, Agent, or Firm*—Daniel Jay Tick

[57] ABSTRACT

A plurality of ice cube grappling members are equiangularly pivotally mounted via pivot pins at the bottom of a tubular member for movement to a closed position in which they come into close proximity with each other at an area beyond the tubular member and to an open position in which they spread apart from each other at the area to encompass and grapple an ice cube. A rod extends through the tubular member and is movable in axial directions therein. A disc is affixed to the rod at an end thereof outside the tubular member and the grappling members are coupled to the disc. A spring in the chamber urges the disc in a direction which maintains the grappling members in closed position. The rod is manually movable against the action of the spring to move the grappling members to open position.

1 Claim, 3 Drawing Figures

ICE CUBE PICKUP DEVICE

BACKGROUND OF THE INVENTION

The present invention relates to an ice cube pickup device.

Ice cube pickup devices are disclosed in the following United States patents. U.S. Pat. No. 1,456,913, issued May 29, 1923 to Busch, U.S. Pat. No. 1,578,800, issued Mar. 30, 1926 to Brandenberger, U.S. Pat. No. 2,116,651, issued May 10, 1938 to Ackerson, U.S. Pat. No. 2,212,013, issued Aug. 20, 1940 to Devareaux, U.S. Pat. No. 2,320,967, issued June 1, 1943 to Dunkelberger, U.S. Pat. No. 2,576,235, issued Nov. 27, 1951 to Nelson, U.S. Pat. No. 2,801,875, issued Aug. 6, 1957 to McEvoy, U.S. Pat. No. 2,810,824, issued Oct. 22, 1957 to Kaufman, U.S. Pat. No. 2,833,584, issued May 6, 1958 to McEvoy and U.S. Pat. No. 2,834,629, issued May 13, 1958 to Williams.

Objects of the invention are to provide an ice cube pickup device of simple structure, which is inexpensive in manufacture, used with facility and convenience, and functions efficiently, effectively and reliably to pick up ice cubes, as desired, thereby maintaining such ice cubes in a completely sanitary condition, since they are untouched by hands.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 2:
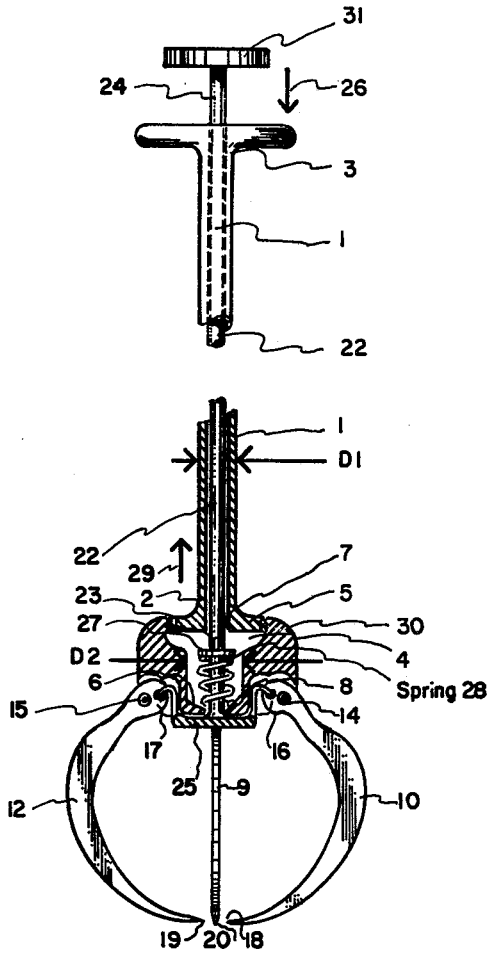
FIG. 2 is a view, on an enlarged scale, partly cutaway and partly in section, of the embodiment of FIG. 1.
Figure 3:
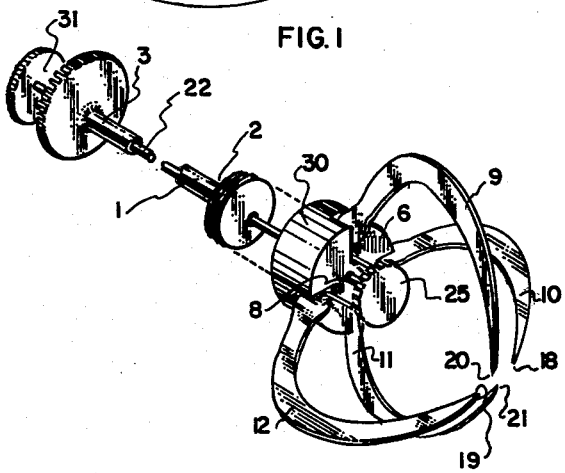
FIG. 3 is a perspective view, on an enlarged scale, partly cutaway, of the embodiment of FIG. 1.

The ice cube pickup device of the invention comprises a tubular member 1 of predetermined diameter D1 (FIG. 2) having spaced opposite first and second ends 2 and 3, respectively (FIGS. 2 and 3). A chamber 4 (FIG. 2) of greater diameter D2 (FIG. 2) than the predetermined diameter D1 is provided at the first end 2 of the tubular member 1. The chamber 4 has spaced opposite top and bottom parts 5 and 6, respectively, with coaxial bores 7 and 8, respectively, formed therethrough, as shown in FIG. 2. Thus, the chamber 4 opens to the tubular member 1, the bore 7 and to the outside of said chamber via the bore 8.

Figure 1:
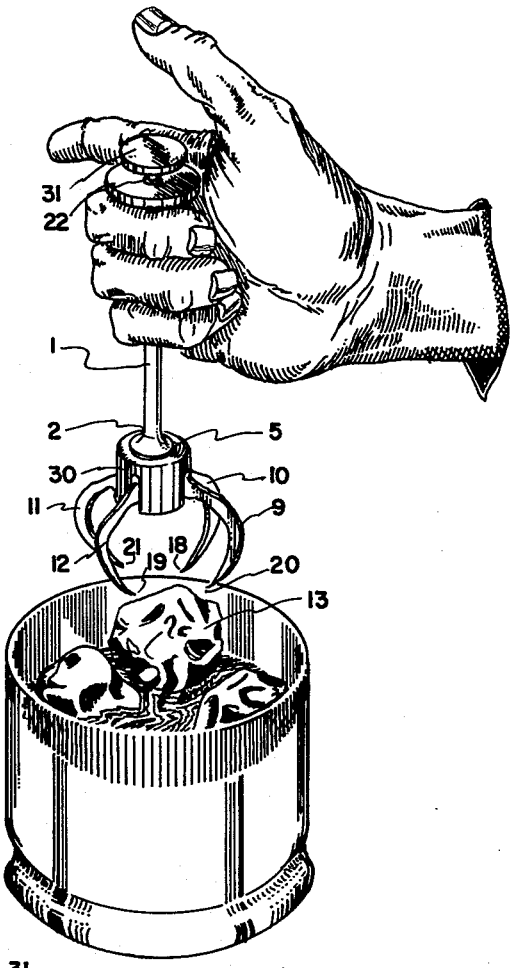
FIG. 1 is a perspective view of an embodiment of the ice cube pickup device of the invention, in use.

A plurality of ice cube grappling members 9, 10, 11 and 12 are equiangularly pivotally mounted via pivot pins at the bottom part 6 of the chamber 4 and extend beyond said bottom part for movement to a closed position, shown in FIGS. 2 and 3, in which they come into close proximity with each other at an area beyond the chamber and substantially coaxial with the tubular member 1, and to an open position, shown in FIG. 1, in which they spread apart from each other at said area to encompass and grapple an ice cube 13 (FIG. 1). As shown in FIG. 2, the grappling members 10 and 12 are pivotally mounted via pivot pins 14 and 15, respectively. The pivot pins of the grappling members 9 and 11 are not shown in the views of the FIGS.

The grappling members 9, 10, 11 and 12 have inner ends at the bottom part 6 of the chamber 4 on one side of their pivot pins and spaced opposite free ends, spaced from said bottom part. Thus, as shown in FIG. 2, the ice cube grappling members 10 and 12 have inner ends 16 and 17, respectively, at the bottom part 6 of the chamber 4, on one side of the chamber 4, on one side of their pivot pins 14 and 15, respectively, and spaced opposite free ends 18 and 19, respectively, spaced from said bottom part. The free ends 20 and 21 of the ice cube grappling members 9 and 11, respectively, are shown in FIGS. 1 and 3.

A rod 22 extends through the tubular member 1 and is movable therein in axial directions. The rod 22 has spaced opposite first and second ends 23 and 24, respectively (FIG. 2), corresponding to the first and second ends 2 and 3, respectively, of the tubular member 1 and spaced outside, and beyond, said first and second ends of said tubular member.

An outer disc 25 (FIGS. 2 and 3) is coaxially affixed to the rod 22 at its first end 23 and movable with said rod away from the first end 2 of the tubular member 1 when the second end 24 of said rod is moved toward the second end 3 of said tubular member, in the direction of an arrow 26, shown in FIG. 2. The outer disc 25 is positioned outside the chamber 4, at the bottom part 6 thereof.

An inner disc 27 (FIG. 2) is coaxially affixed to the rod 22 in the chamber 4 and is movable with said rod toward and away from the bottom part 6 of said chamber.

A spring 28 (FIG. 2) is provided on the rod 22 in the chamber 4 between the inner disc 27 and the bottom part 6 of said chamber. The spring 28 is affixed to the inner disc 27 and urges said inner disc away from the bottom part 6 of the chamber 4, in the direction of an arrow 29, shown in FIG. 2, thereby urging the outer disc 25 into abutment with said bottom part to maintain the grappling members 9 to 12 in closed position, as shown in FIGS. 2 and 3. The rod 22 is manually movable, in the manner shown in FIG. 1, against the action of the spring 28, in the direction of the arrow 26 of FIG. 2, to move the grappling members 9 to 12 to open position, as shown in FIG. 1.

The first end 2 of the tubular member 1 may be threadedly coupled to the housing 30 of the chamber 4, as shown in FIGS. 2 and 3. A head disc 31 is provided at the second end 24 of the rod 22 to facilitate manual pressing thereof.

While the invention has been described by means of a specific example and in a specific embodiment, I do not wish to be limited thereto, for obvious modifications will occur to those skilled in the art without departing from the spirit and scope of the invention.

I claim:

1. An ice cube pickup device, comprising a tubular member of predetermined diameter having spaced opposite first and second ends with a chamber of greater diameter than the predetermined diameter at the first end, said chamber having spaced opposite top and bottom parts with coaxial bores formed therethrough whereby it opens to the tubular member and to the outside of said chamber;

a plurality of ice cube grappling members equiangularly pivotally mounted via pivot pins at the bottom part of said chamber and extending beyond the bottom part of said chamber for movement to a closed position in which they come into close proximity with each other at an area beyond said chamber and substantially coaxial with said tubular member and to an open position in which they spread apart from each other at said area to encompass and grapple an ice cube, each of said grappling members having an inner end at said bottom part on one side of its pivot pin and a spaced opposite free end spaced from said bottom part;

a rod extending through said tubular member and movable therein in axial directions, said rod having spaced opposite first and second ends corresponding to the first and second ends of said tubular member and spaced outside and beyond the first and second ends of said tubular member;

an outer disc coaxially affixed to the rod at its first end outside the chamber and movable with said rod away from said first end of said tubular member when the second end of said rod is manually moved toward the second end of said tubular member, each of said grappling members being coupled at its inner end to said outer disc;

an inner disc coaxially affixed to the rod in said chamber and movable with said rod toward and away from the bottom part of said chamber; and a spring on said rod in said chamber between the inner disc and said bottom part and affixed to said inner disc and urging said inner disc away from said bottom part thereby urging said outer disc into abutment with said bottom part to maintain said grappling members in closed position, said rod being manually movable against the action of the spring to move said grappling members to open position.

* * * * *